US008163989B2

(12) United States Patent
Richard

(10) Patent No.: US 8,163,989 B2
(45) Date of Patent: Apr. 24, 2012

(54) KINETIC ENERGY ENHANCED DRUMSTICK

(76) Inventor: Gary P. Richard, Danvers, MA (US)

( * ) Notice: Subject to any disclaimer, the term of this patent is extended or adjusted under 35 U.S.C. 154(b) by 0 days.

(21) Appl. No.: 12/806,692

(22) Filed: Aug. 19, 2010

(65) Prior Publication Data

US 2011/0162511 A1 Jul. 7, 2011

Related U.S. Application Data

(60) Provisional application No. 61/274,978, filed on Aug. 24, 2009.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS

2004/0231493 A1* 11/2004 Milne et al. ..... 84/422.4
* cited by examiner

*Primary Examiner* — Kimberly Lockett
(74) *Attorney, Agent, or Firm* — David Prashker, Esq.

(57) ABSTRACT

The present invention is an energy enhanced drumstick which provides substantially more kinetic energy per strike and produces a more vibrant sound and desired quality of resonance from a drumstick, all while still maintaining the most desirable features of the traditional drumstick design. This kinetic energy enhanced drumstick is the hybrid structural product of using two or more distinct materials having markedly differing densities which are permanently joined together to form a single unified construct. This hybrid structural product yields a kinetic energy enhanced drumstick comprised of at least one primary material having a first density at its tip end, and has at least one secondary substance having a second density which is greater than the first density of the primary material adjacent the butt end of the drumstick.

12 Claims, 5 Drawing Sheets

Prior Art Fig. 1

KINETIC ENERGY ENHANCED DRUMSTICK

PRIORITY CLAIM

The present invention was first filed on Aug. 24, 2009 as U.S. Provisional Patent Application Ser. No. 61/274,978. The priority and legal benefits of this first filing are expressly claimed herein.

FIELD OF THE INVENTION

The invention is concerned with improvements in drumsticks; and is particularly directed to kinetic energy enhanced drumsticks which allow them to be played longer, harder, and with less fatigue. In addition, these kinetic energy enhanced drumsticks provide more rebound and will play faster than other sticks; and they offer the drummer better tone and less vibration than conventional drumsticks.

BACKGROUND OF THE INVENTION

Drumsticks are rod-like musical implements which are used to beat drums and other percussion instruments in order to produce particular kinds of sounds; and typically are struck by the player in accordance with a certain timing or rhythm to produce a desired frequency or speed of sounds.

There are many known types of drumsticks which vary from beaters, to mallets, to brushes. Although different types of objects to beat drums have existed for centuries, drumsticks as we know them today have only been made for five or six decades. Unfortunately, for many years, drum sticks have had multiple major flaws. For instance, they often became warped, were weighted disproportionately, frequently splintered during use, and cracked easily.

A variety of drumstick improvements have been made which overcome many of these major structural flaws; and the quality of drumsticks has dramatically improved in recent years. Some of these improvements are represented and exemplified in the reported patent literature by the following:

(i) U.S. Pat. No. 4,535,671 discloses a stick type drumstick which achieves improved percussive resonance and tonal qualities while retaining the rigidity required for the reverberation desired in loud drum passages. The improved stick drumstick includes a bundle of elongated, substantially straight wooden rods, which are preferably round hardwood rods such as dowels. The bundle is assembled with longitudinal axes parallel and bound or banded tightly together (as by a rigid plastic tape) for a relatively short span at a location spaced from but relatively closer to the playing or beating end. The rods at the handle end of the bundle are also retained tightly together. A sleeve or overlay retainer may then be applied over the drumstick from the handle end as far as the place where the rods are bound toward the playing end. The combination of the binding of the rods at a span spaced from the beating end and binding the other end at the handle yields a stick type drumstick which has the desired percussive strength, yet it is slightly flexible so that the combination including the interaction of the wooden rods among themselves when a drum is struck yields extraordinarily good tonal qualities.

(ii) U.S. Pat. No. 4,570,527 discloses brush type drum beaters which comprise a bundle or cluster of similar wooden rods firmly secured together at one end to provide a handle and a precisely balanced beater. The remaining portion of the rods are free of restraint and generally uniformly grouped about the axis of the instrument, while the free ends of the rods are relatively closely spaced apart and engagable with the surface of the percussion instrument or with an adjacent rod or rods. Preferably, the rods are of uniform cross section and very substantially larger in section than the filaments of prior brush type drum beaters. These brush type drum beaters are highly resistant to bending, flexing, whipping and injury from use or handling, and the individual rods have very substantial resistance to flexing and strongly resist bending, twisting or breakage and can readily withstand rough usage in use as well as in handling.

(iii) U.S. Pat. No. 5,728,958 discloses a multi-dowel drumstick which has a sheath disposed around the dowels to protect the dowels from damage during use. The sheath typically comprises strips made from an impact resistant polymer which add to the tonal qualities of the multi-dowel drumstick while protecting the dowels. In addition, the multi-dowel drumstick is a percussive which can provide sound without having to strike either a drum surface or cymbal—i.e., the multi-dowel drumstick of the present invention acts as a sound effect device similar to castanets.

(iv) U.S. Pat. No. 6,002,077 discloses a percussion implement comprised of a bundle of a plurality of cylindrically-shaped rod members having outer rod members symmetrically positioned about a like-sized inner rod member held at one end. The bundle of rod members lies in a close-packed relationship with a handle member; and with a movable sleeve member which is positioned about the closely-packed bundle of rod members remote from the handle member and is capable of manual axial movement thereabout to any position of the bundle of rod members, to thereby achieve different sound quality and effects.

(v) U.S. Pat. No. 6,028,260 discloses a drumstick having an adjustable weight system which comprises an elongated hollow tube of specific length that is open at its butt end, and which lies adjacent its tip end and tapers to a bulbous tip end of selected design. The drumstick is symmetrical about a longitudinal axis and is provided at its distal tip end with a small bore that communicates with the larger hollow interior of the drumstick. Mounted within the hollow interior of the drumstick is an elongated threaded spindle that extends nearly the entire length of the drumstick. Adjustably mounted on the threaded spindle (at a selected location that suits the drummer), are one or more discrete weights—each of which weighs exactly the same amount as all the other weights. The weights are locked in position between a pair lock members mounted on the spindle. A damper member is provided in the tip-end of the hollow drumstick; and a plurality of annular silencers are spaced along the length of the threaded spindle to retain the threaded spindle axially aligned within the hollow drumstick. A retainer plug mounted on the proximal end of the threaded spindle is press-fitted into the open butt end of the drumstick to retain the adjustable weight assembly system within the drumstick.

(vi) U.S. Pat. No. 7,084,339 discloses a stick type drumstick which includes a plurality of elongated reasonably straight wooden rods formed around a central foam core. The central foam core is comprised of a larger diameter sized wooden rod, shorter in length and having attached to one end a foam rod of the same diameter. The plurality of rods which match the length of the central foam core are placed around its outside diameter; and a retaining sleeve is securely fitted over the gripping end creating a handle. At the opposite or playing end, an additional retaining sleeve shorter in length is secured slightly back from playing end to allow some flexibility for the outer rods, but not allowing them to spread or splay allowing the foam core to slide out of position.

(vii) U.S. Pat. No. 7,538,264 discloses an ergonomic durable drumstick comprising a tapered substantially hollow percussion member having a distal end and a proximal end; a tubular body formed with a chamber monolithically extending from the proximal end which has a circumference less than the circumference of the proximal end of the tapered substantially hollow percussion member; and a plug having a circular cross-section formed with a conical leading end monolithically extending from the distal end of the tapered substantially hollow percussion member, wherein the plug includes a plurality of annular rings protruding from the outer surface of the plug between the conical leading end. The distal end of the percussion member is adapted to fixedly engage a drumhead contact tip; and a drumhead contact tip formed with a hollow bore (having a closed end and an open end) is adapted to receive the plug.

(viii) United States Patent Application Serial No. 2006/0027073 discloses an ergonomic drumstick having a plurality of rings which form ridges configured to circumferentially encompass a drumstick, the plurality of rings being located non-equidistant from each other on the drumstick such that the rings ergonomically conform to the grip of a hand. The rings are made of a softer material than the drumstick to provide comfort for the hand; and the drumstick grip may be adjustable to provide greater comfort to the drummer's hand.

Other Drummer Problems

Despite the range and variety of such improvements, many drummers today continue to have substantive difficulties with their drumsticks. Some of these are the following:

- Many drummers wear out their drum sticks in the middle of the shaft by playing rimshots all night long. This causes the drumsticks to splinter and eventually wear completely through.
- Many drummers like to spin their drumsticks, which requires a carefully balanced drumstick and as well as a coordinated hand movement. Drumstick spinning has gained popularity through the past several years. There are multiple drumstick spinning books and dvd's which teach drumstick spinning.
- Many drummers like to pitch-match their drum sticks. Such drummers always make sure that their sticks audibly match each other in pitch.
- Some drummers prefer to use metal drumsticks for their practice sessions. Nevertheless, the use of metal drumsticks is and remains a highly controversial subject. Many music educators believe in this practice, while other are convinced that it is harmful to one's wrists.
- Some drummers sand their drum sticks to remove the varnish. These drummers like the feel of the so-called "naked drumsticks" better, usually because it is those drummers that sweat a lot during play.
- Drummers often break their drumsticks because they play too hard, or hit the drums at the wrong angles, or use the wrong type of drumsticks for their particular style
- Some drummers need more instruction on how to hold drumsticks. The drummer's hands cannot be too far back on the drumsticks, nor should the drummer's hands be too far forward on the sticks. It is important to find the proper balancing point.
- Snare drumsticks should be heavier for new snare drummers. The heavier drumstick provides extra weight, which helps the novice snare drummer to build up his muscular strength.

Materials Conventionally Used to Make Modern Drumsticks

Today, drumsticks are commercially manufactured from different types of materials, the traditional and most popular drumstick being made of wood. Wooden drumsticks are very popular, and most drummers prefer using wooden drumsticks because they are more flexible and reduce friction. The preferred wooden drum sticks are frequently made of a single piece of resilient wood such as oak, maple and hickory. Conventionally however, if the type of wood is not specified by the manufacturer, then that drumstick is most likely made using a mixture of different woods; and for this reason, would generally be deemed to be of low quality.

Hickory drumsticks are the most commonly made, because this kind of wood is very flexible; absorbs the shock of striking the drum better; and allows the person's hands to avoid feeling the stress. Also, wooden drumsticks made from hickory last a lot longer than oak and maple drumsticks. In addition, hickory can absorb much more shock than other types of wood, thereby making it easier to hit the cymbals and reduce fatigue in the hands and wrists.

In comparison, wooden drumsticks made of oak are the heaviest, the strongest type of wood; and oak makes the drumstick more durable, but does not help in reducing the friction. The third preferred wood, maple, provides drumsticks which are by far the lightest in weight among the three best wooden types.

In addition to wooden drumsticks, there are commercially sold and available today alternatives such as carbon drumsticks, laser drumsticks, and snare drumsticks for percussion instruments like drums. As an illustrative alternative, carbon drumsticks are made of a carbon-containing polymer which offers the same weight and balance as wooden drumsticks, but are far more stiff (inflexible) and are capable of absorbing as much shock impact, if not more, as hickory drumsticks. However, to an experienced drummer, carbon drumsticks definitely feel different from wooden drumsticks. Note however, when selecting percussion drumsticks, wooden drumsticks are the cheapest and popularly available option.

Conventionally Known Drumstick Designs

Drumsticks are designed to impinge on percussion section instruments in music played by orchestras, jazz groups, and rock bands. Generally manufactured from an arduous and resilient material, a classic drumstick is roughly 16.3 inches long, 0.635 inches diameter, and bears a circular tip. However, although the most commonly used drumstick today is about 16 inches in length, some extended-length drumsticks are 16.5 inches and even 17.0 inches in length.

Novice, intermediate, advanced, and professional musicians all buy and use drumsticks to create percussion sounds. Most professional drummers are very demanding about a drumstick's free weight, cast, equilibrium, sizing, granulate, and concentration—because the more specific the design requirements of the drumstick, the more superior is the caliber of the drumstick and the more unique is the distinctive quality of the produced sound. These variables affect the maneuverability and mechanics of the drummer's play; consequently, drummers will at times change their choice of sticks to match the desired style and sound of a given song or music.

A well designed drumstick typically includes four different parts, as is illustrated by Prior Art FIG. 1. As seen therein, a conventional drumstick 10 comprises a tip or crest 12, a neck 14, a shoulder or taper portion 16, a body or shaft portion 18, and a butt end 20. The tip 12 (also known as a crest or bead) is the uppermost portion of the drumstick that collides with the drum surface. Traditionally, the tip 12 is constructed of an arduous wood, although drumsticks with fictile nylon, and other material crests are also available if desired. The shape of the tip can also be varied to suit the drummer's preferences; and round, triangular, barrel-shaped, or oval tips are frequently chosen.

The neck 14 is the small part of drumstick that connects the tip to the shoulder. The neck is usually the thinnest part of drumstick, with the exception of some specialty drumsticks and mallets that are intentionally not narrow near the tip.

Immediately adjacent the tip 12 and neck 14 portions is the shoulder 16 of the drumstick 10. The shoulder portion 16 is often employed to strike hi hats, clang cymbals, bells, and wood blocks.

The remainder of the drumstick design includes the body or shaft portion 18 and the rod-like butt end 20, which lies directly adjacent to and below the shaft 18 and forms the opposite end of the drumstick 10 to be held by the hand of the drummer. The body or shaft 18 provides most of the linear length of the drumstick. The butt 20 is the thicker, counter balance end of the drumstick 10; and although was not specifically designed as the part to play, some drummers flip drumsticks to use the butt ends for specialty effects.

The Different Varieties of Drumsticks

If one is a musician and loves to play the drums, he (or she) would be aware of the various types of drumsticks that are available in the commercial market today. Each variety of drumstick produces a different effect on the drums or other instrument. Thus in addition to wooden drumsticks, the varieties today include percussion drumsticks, carbon drumsticks, snare drumsticks, and laser drumsticks.

The snare drumsticks are a type of drumstick usually wrapped with a white colored tape or even another material such as metal; and is a formed using a PVC sleeve that supports the person to protect his drumstick. In comparison, the percussion drumstick is typically formed of any material that has the character of producing a sound when hitting an object and thereby makes a vibration which is perceived by the human ear as sound. Carbon drumsticks are made of a carbon-containing polymer which offers the same weight and balance as wooden drumsticks, but are inflexible and are capable of absorbing considerable shock impact. In contrast, the laser drumstick is merely a conventional drumstick which has been laser imprinted over its exterior surface.

Some Long-Recognized Remaining Problems

The manner of using drumsticks to produce musical sounds has been known for many centuries. These instruments are generally held in a relatively loose grip by the human hand; and the tip or point end is then struck against a surface such as a drum face or other surface. Vibrations are induced by this striking action in the drumstick itself as well as in the surface being struck.

When a surface is struck, the induced (shock excited) vibrational energy traverses the length of the drumstick and helps produce a "live" sound—if the instrument's user does not grip the stick too firmly. However, if the hand grip is too great, the vibrational energy will be coupled to the hand of the user and the energy becomes dissipated, because the human hand acts as an energy absorbing sink. In these instances, the highly desired unique sound quality and particular energy resonance created by the striking of the drumstick becomes distorted, diminished, or entirely lost.

To avoid these undesirable effects, persons using drumsticks generally use a relatively light hand grip. This technique, however, has in many cases causes undesirable results in that, during the course of playing an instrumental piece, the sometimes drumstick slips from the user's grasp and flies through the air. This is especially true where the user has become fatigued and/or his or her hands become damp from perspiration.

A long sought and most desired goal, therefore remains, which is: To provide an unique drumstick that can be played longer and faster, requires less drummer energy to play, and produces a desired resonance and quality of sound that is not diminished by the grip strength of the drummer's hand.

SUMMARY OF THE INVENTION

The present invention has multiple aspects.

One aspect provides a kinetic energy enhanced drumstick comprised of at least one primary material having a first density and at least one secondary substance having a second density which is greater than the first density of the primary material, wherein said drumstick has (i) a predetermined length and known girth dimensions, (ii) a fixed configuration which presents a shaped tip, an elongated shaft portion, and a butt end, (iii) a mass center location at which the drumstick length can be separated into discrete forward and rearward sections, (iv) a forward section fashioned entirely of said primary material having said first density, and (v) a rearward section fashioned entirely of said secondary substance having said second density.

Another aspect of the invention provides a kinetic energy enhanced drumstick comprised of at least one primary material having a first density and at least one secondary substance having a second density which is greater than the first density of the primary material, wherein said drumstick has (i) a predetermined length and known girth dimensions, (ii) a fixed configuration which presents a shaped tip, an elongated shaft portion, and a butt end, (iii) a mass center location at which the drumstick length can be separated into discrete forward and rearward sections, (iv) a forward section fashioned at least of said primary material having said first density, and (v) a rearward section fashioned at least from a combination of said primary material having said first density and said secondary substance having said second density.

A third aspect of the invention provides a kinetic energy enhanced drumstick comprised of at least one primary material having a first density and at least one secondary substance having a second density which is greater than the first density of the primary material, wherein said drumstick has (i) a predetermined length and known girth dimensions, (ii) a fixed configuration which presents a shaped tip, an elongated shaft portion, and a butt end, (iii) a mass center location at which the drumstick length can be separated into discrete forward and rearward sections, (iv) a forward section fashioned of said primary material having said first density, (v) a rearward section whose exterior surface is formed at least in part of said primary material having said first density, (vi) at least one interior cavity of preset shape, dimensions, and volume housed within said rearward section, and (vii) a predetermined amount of said secondary substance having said second density disposed within said interior cavity in said rearward section.

BRIEF DESCRIPTION OF THE DRAWING

The present invention may be more readily appreciated and better understood when taken in conjunction with the accompanying Drawing, in which:

Prior Art FIG. 1 is an overhead view of a traditional drumstick design;

DETAILED DESCRIPTION OF THE PRESENT INVENTION

Figure 2A:
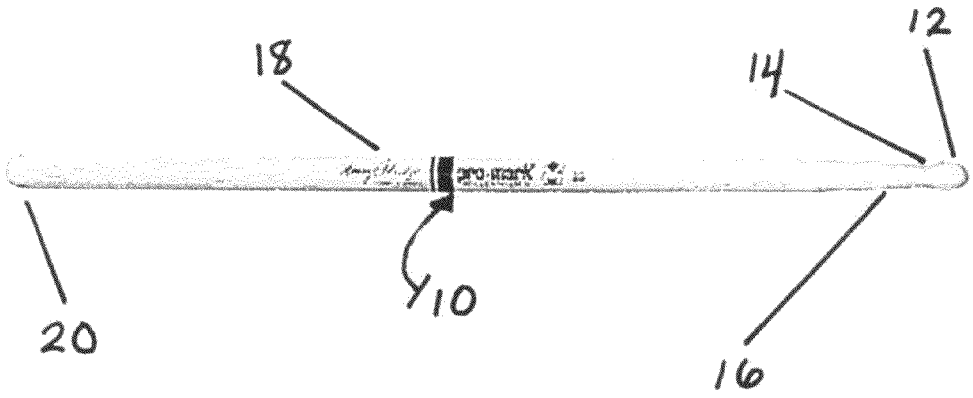
FIGS. 2A and 2B are different perspectives views of an kinetic energy enhanced drumstick comprising the present invention.

As stated above, the majority of drumsticks used today are made of wood. Wood is a fibrous material made largely from cellulose and lignin. The varieties of woods, as opposed to other materials, add tone and resonance to the sound produced by the drumstick strike; and they provide a controllable action and "kick" when beating a drum surface. Woods also absorb much more of the vibration, or impact shock of the strike against any object.

I. Enhancing Kinetic Energy

The strike movement of and sound generated by a drumstick is a function of its kinetic energy. Kinetic energy is defined as the energy possessed by an object because of its motion. All moving objects have kinetic energy. The amount of kinetic energy depends upon the mass and speed of the object. Mathematically, it is defined as one-half the product of a body's mass and the square of its speed, KE=½*mass*velocity squared. Therefore, the greater the mass and speed of movement for the drumstick, the greater the kinetic energy which is produced.

Energy of motion is proportional to the total weight of the drumstick and the square of its speed. Thus if a drumstick's mass (density or weight) is doubled, the kinetic energy produced by a striking will increase directly two fold—i.e., a doubling of kinetic energy. But if the speed (or velocity) at which a drumstick having a fixed mass strikes the drum (or other object) is doubled, its kinetic energy increases by a factor of two squared—i.e., a four fold increase of energy. In this regard, it is noted also that woods generally have a lower mass density than metals or metallic alloys.

Nevertheless, an increase in the mass (density or weight) of a drumstick in order to increase its kinetic energy potential is not conventionally deemed to be practical. Using a more dense wood (such as mahogany) would yield a drumstick which is more vibrant and resonant sound producing—but such denser wood varieties are generally heavier; would be far more difficult to use at higher speeds; and would also markedly add to the drummer's fatigue. These more dense woods, being harder materials, would also generally add to the damaging vibrations and continuing shocks entering into the player's hands and arms whenever a drum or other instrument is struck.

II. The Invention as a Whole

The present invention uses and relies upon a different and unusual construction in order to produce an energy enhanced drumstick which provides substantially more kinetic energy per strike and produces a more vibrant sound and desired quality of resonance, all while still maintaining the most desirable features of the traditional drumstick design. This kinetic energy enhanced drumstick is a hybrid structural product obtained by using two or more distinct materials having markedly differing densities, and which are permanently joined together to form a single unified construct. This hybrid structural product and manner of construction yields a kinetic energy enhanced drumstick comprised of at least one primary material having a first density at its tip end; and has at least one secondary substance having a second density which is greater than the first density of the primary material adjacent to or at the butt end of the drumstick.

Via this mode and manner of construction, the use and inclusion of a sufficient quantity of a more dense and vibrant secondary substance adjacent to or at the butt end of the drumstick, the necessary additional mass (density) needed to generate more kinetic energy per strike is present without adding any extra weight forward of the drumstick's mass center or balance fulcrum—any extra weight on the forward portion of the drumstick being a most undesirable situation and condition which would meaningfully add to the drummer's fatigue and detract from his performance.

Note also that the presence of an added weight or mass of a more dense material within the rearward portion of the drumstick markedly shifts the location or determinable point of the drumstick's mass center or fulcrum balance point towards the butt end, thereby making the front tip, neck and shoulder feel lighter when the construct is held in the drummer's normal hand position. Consequently, in both effect and function, the use and presence of the more dense secondary material within the rearward section, adjacent or at the butt end of the drumstick, acts as a counter weight at the butt end; a counterweight which makes the longer length front section of the drumstick (the tip, neck and shoulder) easier to be raised and lifted, and faster in actual use—and which adds to the kinetic energy formula and effect of speed squared.

III. Exemplary Models of Alternative Structural Constructs

The present invention can be structured in not less than three different and alternative exemplary model constructs. Each of the three different and alternative model constructs has its own particular advantages and benefits; and the full range of structural constructs allows the drummer to choose among the different construct designs and to pick an embodiment which is most suitable for his individual playing style.

Exemplary Model Construct A

Exemplary model construct A is a kinetic energy enhanced drumstick comprised of at least one primary material having a first density and at least one secondary substance having a second density which is greater than the first density of the primary material, wherein the drumstick has a predetermined length and known girth dimensions, a fixed configuration which presents a shaped tip, an elongated shaft portion, and a butt end, a mass center location at which the drumstick length can be separated into discrete forward and rearward sections, a forward section fashioned of said primary material having said first density, a rearward section whose exterior surface is formed at least in part of said primary material having said first density, at least one interior cavity of preset shape, dimensions, and volume housed within said rearward section, and a predetermined amount of said secondary substance having said second density disposed within said interior cavity in said rearward section.

Figure 2B:
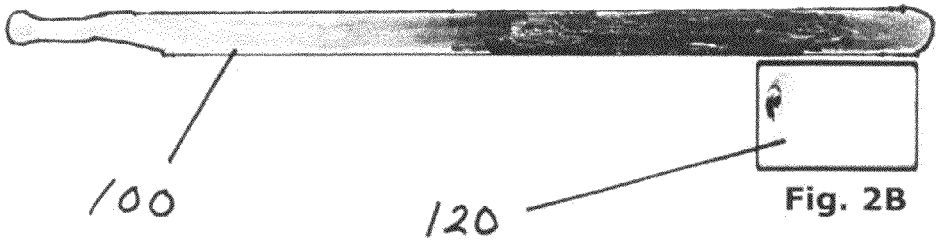

One preferred embodiment of this exemplary model construct is illustrated by FIGS. 2A-2B and 3A-3B respectively. As shown therein, FIG. 2A is an overhead pictorial view of a kinetic energy enhanced drumstick 100, while FIG. 2B shows a detailed view of the butt end 120 of the kinetic energy enhanced drumstick 100.

Figure 3A:
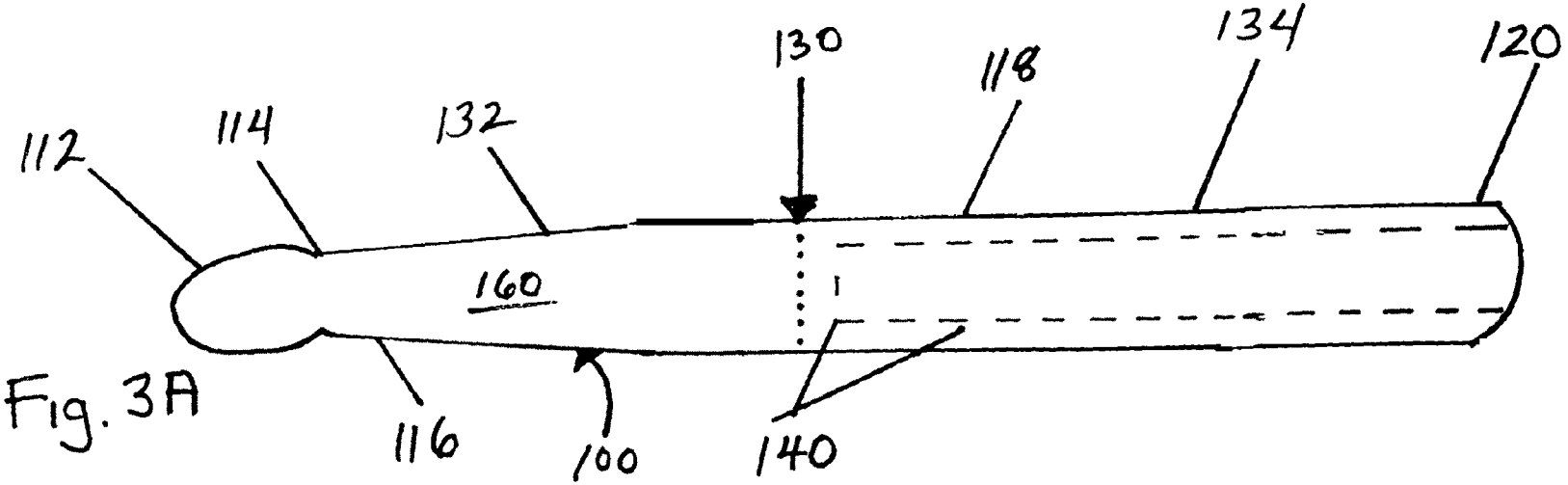
FIGS. 3A and 3B are perspective and cross-sectional views of one desirable format of exemplary model construct A of the present invention.
Figure 3B:
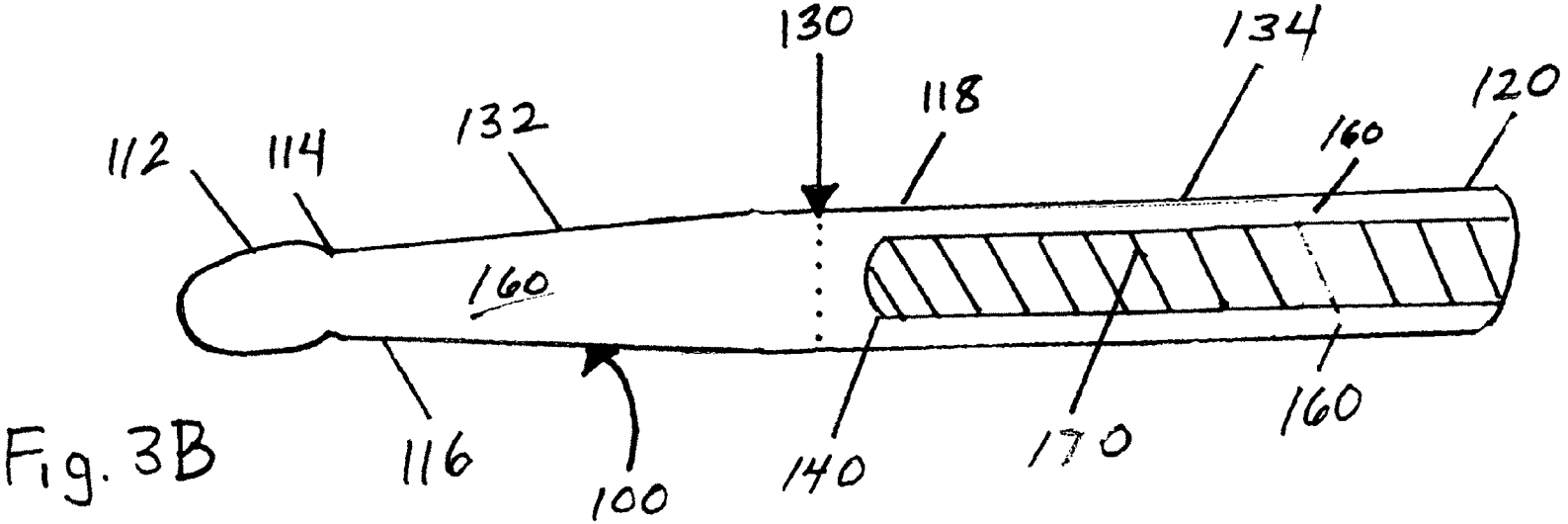

Further details of this model construct are illustrated by FIGS. 3A and 3B respectively. FIG. 3A is a schematic view of the kinetic energy enhanced drumstick 100, while FIG. 3B shows a cross-sectional view of the structure.

Thus, the kinetic energy enhanced drumstick 100 includes a tip or crest 112, a neck 114, a shoulder or taper portion 116, a body or shaft portion 118, and a butt end 120. The tip 112 (also known as a crest or bead) is the uppermost portion of the kinetic energy enhanced drumstick 100 that will collide with a drum surface.

The kinetic energy enhanced drumstick 100 includes a mass center location and fulcrum balance point 130 which demonstrably divides and separates the drumstick length into a discrete and balanced forward section 132 and a discrete and equally balanced rearward section 134. It will be recognized also that the forward section 132 is comprised of at least one primary material 160 having a predetermined first density; and that the rearward section 134 is comprised in part of at least one secondary substance 170 having a known second density which is identifiably greater than the density of the primary material 160.

Within the exterior dimensions of the rearward section 134 is an interior cavity 140 having a predetermined shape, fixed dimensions, and preset volume. It is noted that the interior cavity 140 physically exists and lies disposed inside the limits of the rearward section 134 and is housed solely within the material confines of the rearward section 134. In addition, the interior cavity 140 holds the totality of the secondary substance 170 (having a known second density which is identifiably greater than the density of the primary material 160)—which is shaped to be in conformity with the true configuration and dimensions of the interior cavity space 140. Accordingly, as seen in FIG. 3B, the secondary substance 170 is contained entirely by, and preferably completely fills the void volume of, the interior cavity space 140.

It will be appreciated also that the presence of the secondary substance 170—which is contained entirely by, and preferably completely fills the void volume of, the interior cavity space 140 within the rearward portion of the drumstick—has markedly shifted the location of the drumstick's mass center or fulcrum balance point 130 towards the butt end 120 when compared to conventional drumsticks, thereby making the front tip 112, the neck 114, and the shoulder 116 feel lighter than usual when the model construct 100 is held in the drummer's normal hand position. Thus, in both effect and function, the presence of the more dense secondary material 170 within the interior cavity 140 of the rearward section acts as a counter weight which makes the longer length front section 132 of the model construct 100 easier to be raised and lifted, and faster to use.

It will be appreciated also that the secondary substance 170 contained within the void volume of the interior cavity space 140 can optionally be prepared as a removable on-demand article which can be withdrawn at will and replaced as desired with another similarly configured and dimensioned secondary substance having a different density (but one which is greater than the density of the primary material 160). Thus, an initially used secondary substance constituted of a dense wood (e.g., oak, hickory, or maple) can be substituted on-demand by another similarly configured and dimensioned secondary substance constituted of a metal or metallic alloy (e.g., brass, iron, or lead). Suitable article configurations for such at will substitutions and replacements of the secondary substance typically include helical or screw threaded structures; rod or oval shaped articles with a removable sealing cap; multiple ball or cylinder shaped inserts with a removable sealing cap; and many other formats which lend themselves to filling the void volume of the interior cavity space 140.

Figure 4A:
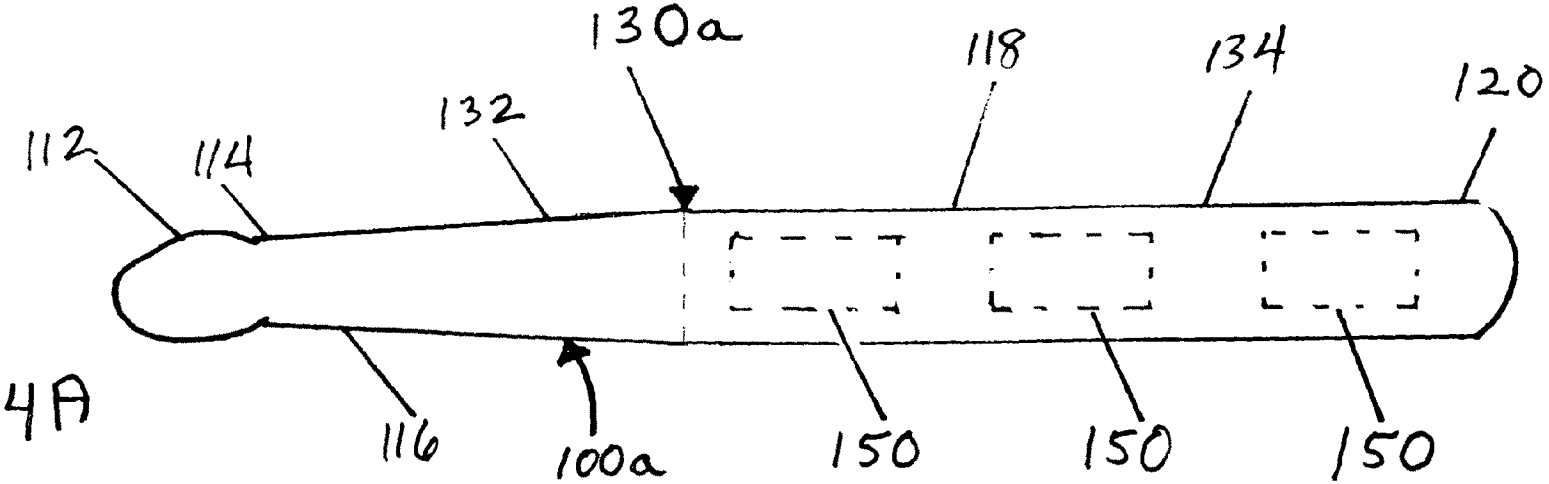
FIGS. 4A and 4B are perspective and cross-sectional views of another desirable format of exemplary model construct A of the present invention.
Figure 4B:
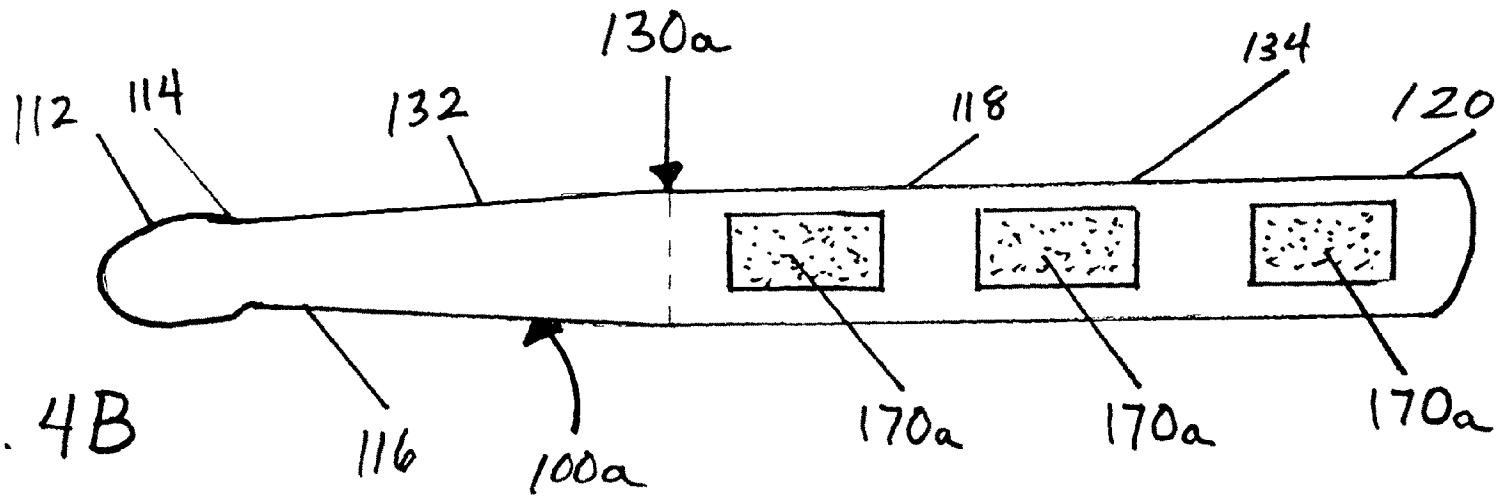

Another preferred embodiment of this same model construct type is illustrated by FIGS. 4A-4B respectively. FIG. 4A is a schematic view of the kinetic energy enhanced drumstick 100*a*, while FIG. 4B shows a cross-sectional view of the embodiment.

In this particular embodiment, the kinetic energy enhanced drumstick 100*a* also typically comprises a tip or crest 112, a neck 114, a shoulder or taper portion 116, a body or shaft portion 118, and a butt end 120. It will be recognized also that the forward section 132 is comprised of at least one primary material 160 having a predetermined first density; and that the rearward section 134 is comprised in part of at least one secondary substance 170 having a known second density which is identifiably greater than the density of the primary material 160.

As shown, the kinetic energy enhanced drumstick 100*a* has a mass center location and fulcrum balance point 130*a* which demonstrably divides and separates the drumstick length into a discrete and balanced forward section 132 and a discrete and equally balanced rearward section 134. However, it will be recognized that the mass center and fulcrum balance point 130*a* for the drumstick 100*a* seen in FIGS. 4A and 4B lies at a different linear location along the length of the drumstick when compared to the fulcrum balance point 130 for the drumstick 100 of FIGS. 3A and 3B. This change in mass center location and balance point occurs because the rearward section 134 has a differently constructed interior cavity 150.

Thus, FIG. 4 as a whole shows that, disposed within the exterior dimensions of the rearward section 134, are a plurality of small interior cavities 150—each of which has a predetermined shape, fixed dimensions, and preset volume. It is preferred that each of the small interior cavities 150 be identical in shape and void volume, but this is not a compulsory requirement. Neither is the actual number of small internal cavities 150 which reside within the rearward section 134 of any importance. Consequently, the true number of interior cavities 150—as well as the shape, dimensions and void volume of each cavity 150—is merely a matter of personal preference and individual design parameters.

Attention is directed to several structural features in the embodiment illustrated by FIGS. 4A and 4B:

(i) Each of the three small interior cavities 150 physically exists and lies disposed inside the limits of the rearward section 134; and each of the small interior cavities 150 is housed solely within the material confines of the rearward section 134.

(ii) Each of the small interior cavities 150 holds a fixed amount of the secondary substance 170*a* (having a known second density which is identifiably greater than the density of the primary material 160) and which is shaped to be in conformity with the true configuration and dimensions of the interior cavity space 150. As seen in FIG. 4B, it is merely preferred that the secondary substance 170 be contained entirely by and completely fill the void volume of each small interior cavity 150.

(iii) The series of small internal cavities 150 lie within the material substance of the rearward section 134, which is typically comprised of the less dense primary material 160—but can if desired be a third material as long as this third material is also less dense than the known density of the secondary substance 170*a*.

(iv) The series of small internal cavities 150 are disposed within the rearward section 134 adjacent to the butt end 120 of the construct 100*a*. Thus, there is no small cavity 150, nor any secondary material 170*a*, which appears or lies at the butt end 120 itself. This arrangement is thus structurally different from the construct shown by FIGS. 2A, 3A, and 3B respectively.

Exemplary Model Construct B

Exemplary model construct B of the present invention is a kinetic energy enhanced drumstick comprised of at least one primary material having a first density and at least one secondary substance having a second density which is greater than the first density of the primary material, wherein said drumstick has a predetermined length and known girth dimensions, a fixed configuration which presents a shaped tip, an elongated shaft portion, and a butt end, a mass center location at which the drumstick length can be separated into discrete forward and rearward sections, a forward section fashioned of at least said primary material having said first density, and a rearward section fashioned as a combination of at least said primary material having said lesser first density and said secondary substance having said greater second density.

Figure 5A:
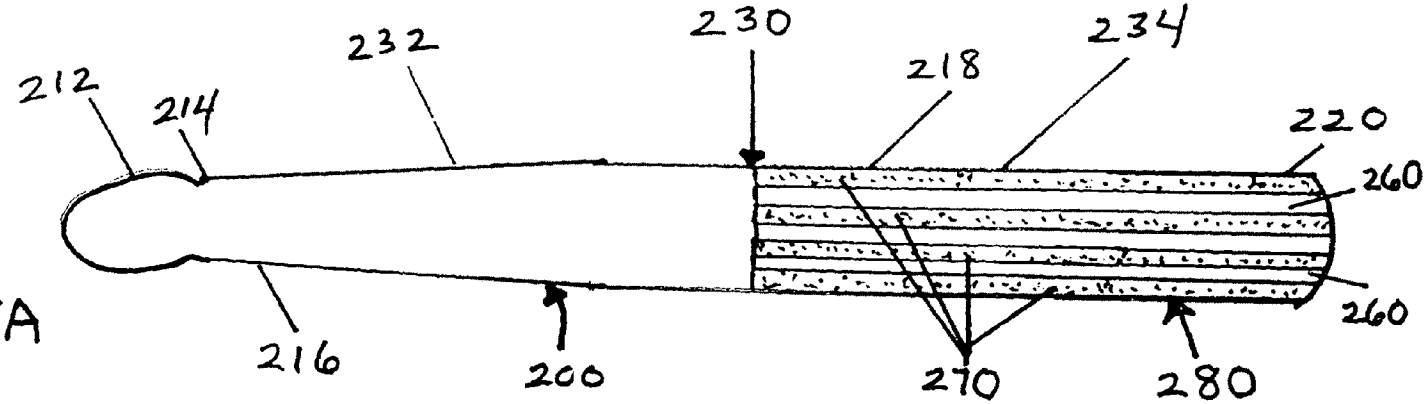
FIGS. 5A and 5B are perspective and cross-sectional views of exemplary model construct B of the present invention.
Figure 5B:
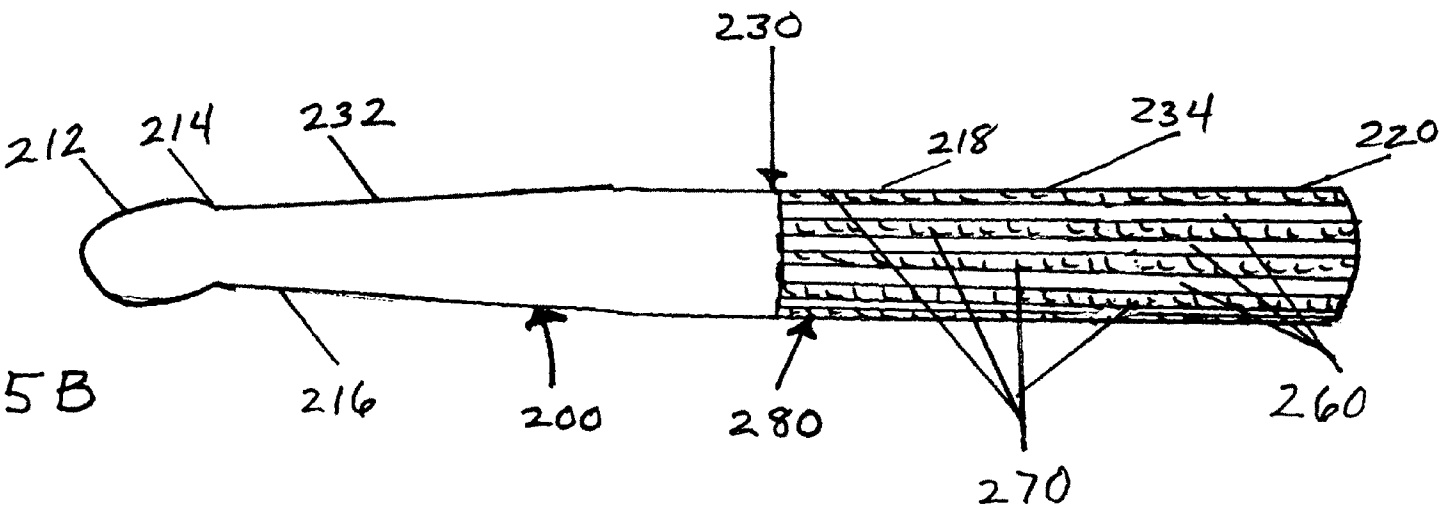

Some details of this model construct are illustrated by FIGS. 5A and 5B respectively. Accordingly, FIG. 5A is a schematic view of the kinetic energy enhanced drumstick 100, while FIG. 5B shows a cross-sectional view of the model structure.

Thus as seen therein, a kinetic energy enhanced drumstick 200 comprises a tip or crest 212, a neck 214, a shoulder or taper portion 216, a body or shaft portion 218, and a butt end 220. Accordingly, the kinetic energy enhanced drumstick 200 has a predetermined length, known girth dimensions, and a fixed configuration.

The kinetic energy enhanced drumstick 200 also includes a mass center location and fulcrum balance point 230 which demonstrably divides and separates the drumstick length into a discrete and balanced forward section 232 and a discrete and equally balanced rearward section 234. In general, the forward section 232 is comprised of at least one primary material 160 having a predetermined first density; but, if desired, the forward section 232 may optionally be formed as mixture of two or more primary materials, each having its own individually known or determinable density.

In comparison, the rearward section 234 is comprised in part of at least one secondary substance 270 having a known second density which is identifiably greater than the density of the single primary material 160; or if a mixture of two or more primary materials 260 (each having its own individually known or determinable density) is used in the forward section 232—then the rearward section 234 is comprised in part of at least one secondary substance 270 having a known second density which is identifiably greater in value than any of the densities for the multiple primary materials 260.

This overall result is illustrated by FIGS. 5A and 5B which show the rearward section 234 as a preformed laminated composite 280—which is fabricated in advance of its use by the juncture of alternating individual layers constituted of least one primary material 260 (of a lesser density) and at least one secondary substance 270 (having a greater density than any primary material 260). Furthermore, as seen in FIGS. 5A and 5B, the prefabricated laminated composite 280 is made as a series of single planar layers joined together in parallel sequence to form a unitary laminate article; which is then sized and configured to become the rearward section 234; and which then is itself tangibly and permanently joined to the forward section 232 via conventionally known means to create and produce a kinetic energy enhanced drumstick 200. Consequently, in this exemplary model construct B, the secondary substance 270 is a direct constituent and major part of the rearward portion 234 of the drumstick 200 via its use in making the preformed laminated composite 280.

Moreover, as shown by FIGS. 5A and 5B, the location of the drumstick's mass center or fulcrum balance point 230 for the exemplary model construct B lies more towards the butt end 220 when compared to the mass center point of conventional drumsticks; thereby making the front tip 212, the neck 214, and the shoulder 216 feel far lighter than usual when the model construct 200 is held in the drummer's normal hand position. Thus, in both effect and function, the presence of the more dense secondary material 270 within the prefabricated laminated composite 280 in the rearward section 234 acts as a counter weight which makes the longer length front section 232 of the model construct 200 easier to be raised and lifted, and faster to use.

It will be recognized and appreciated also that a prefabricated laminated composite formed via a series of single planar layers joined together to form a unitary laminate article is not the only possible format useful in this model construct. To the contrary, any type of prefabricated laminated composite fashioned as a combination of at least one primary material having a lesser first density and at least one secondary substance having a greater second density is acceptable and useful for purposes of making a rearward section suitable for use in the exemplary model construct B drumstick. Thus, non-planar and non-parallel layers may certainly be used; and the alignment and orientations of the primary material and the secondary substance may alternatively be regular or irregular, be geometric or not geometric, be coherent or not coherent, and either lie in parallel or not. All of these variations are permitted and are deemed to be within the scope and intent of the present invention.

It will be noted also that one expected and intended variation of this exemplary model construct B format is that the secondary substance can be optionally prepared as an independent and separate external circular ring or oval overlay article that is to be located upon and installed over the exterior surface of the rearward section; and once installed, will create the same kinetic energy enhancement effect. In this optional variant, the external circular ring or oval overlay article is prepared in advance as a configured and dimensioned article having an aperture or opening in its center such that the linear length of the drumstick can pass there through; and the external circular ring or oval overlay article has a means of attachment to the exterior surface of the drumstick such that the ring or oval can be located and positioned anywhere within the linear length of the rearward section of the drumstick. In this manner and via this mode of construction, the requirement that the rearward section be fashioned as a combination of at least one primary material having a lesser first density and at least one secondary substance having a greater second density is effectively met and satisfied.

Exemplary Model Construct C

Exemplary model construct C is a kinetic energy enhanced drumstick comprised of at least one primary material having a first density and at least one secondary substance having a second density which is greater than the first density of the primary material, wherein said drumstick has a predetermined length and known girth dimensions, a fixed configuration which presents a shaped tip, an elongated shaft portion, and a butt end, a mass center location at which the drumstick length can be separated into discrete forward and rearward sections, a forward section fashioned entirely of said primary material having said first density, and a rearward section fashioned entirely of said secondary substance having said second density.

Figure 6A:
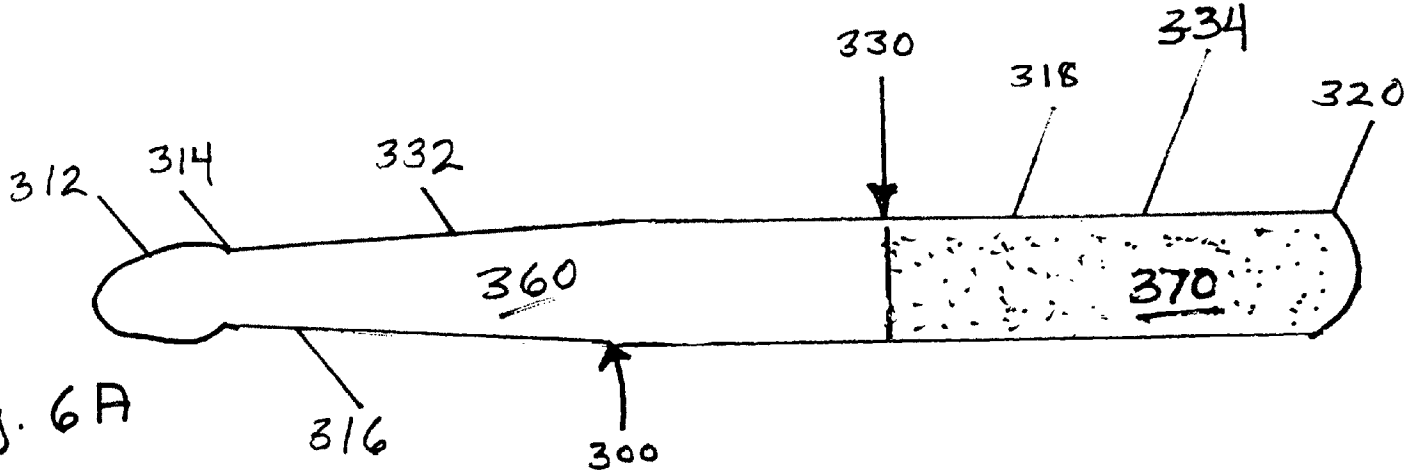
FIGS. 6A and 6B are perspective and cross-sectional views of exemplary model construct C of the present invention
Figure 6B:
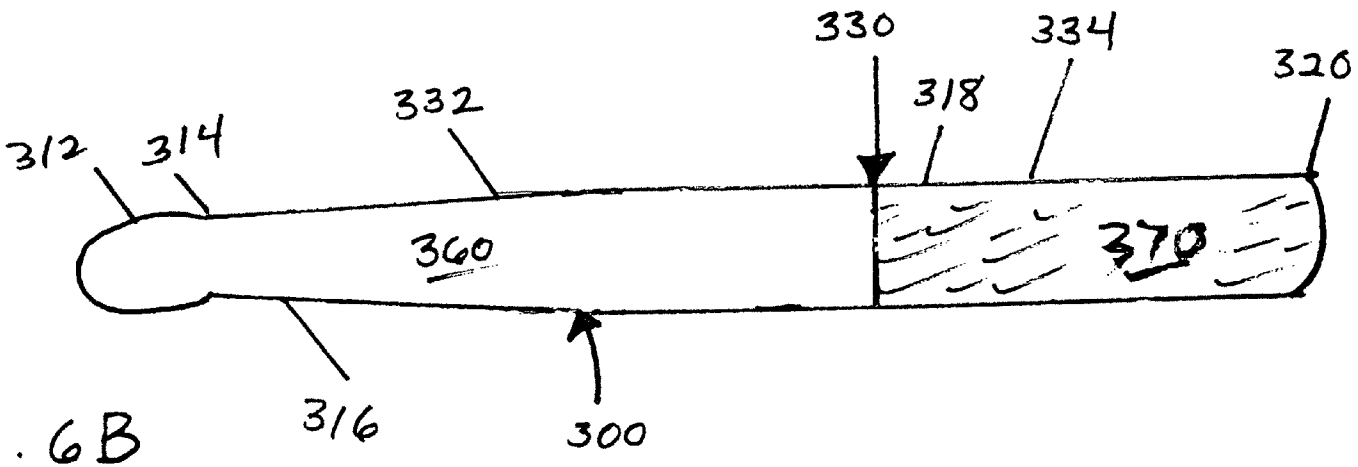

The details of this model construct are illustrated by FIGS. 6A and 6B respectively. Accordingly, FIG. 6A presents a schematic view of the kinetic energy enhanced drumstick 300, while FIG. 6B provides a cross-sectional view of the same model structure.

As seen therein, a kinetic energy enhanced drumstick 300 comprises a tip or crest 312, a neck 314, a shoulder or taper portion 316, a body or shaft portion 318, and a butt end 320. In short, the kinetic energy enhanced drumstick 300 has a predetermined length, known girth dimensions, and a fixed configuration.

The kinetic energy enhanced drumstick 300 also includes a mass center location and fulcrum balance point 330, a position which demonstrably divides and separates the drumstick length into a discrete and balanced forward section 332 and a discrete and equally balanced rearward section 334. In general, the forward section 332 is comprised of at least one primary material 360 having a predetermined first density; but, if desired, the forward section 332 may optionally be formed as mixture of two or more primary materials, each having its own individually known or determinable density.

In comparison, the discrete rearward section 334 is comprised in part of at least one secondary substance 370 having a known second density which is identifiably greater than the density of the single primary material 360; or if a mixture of two or more primary materials 360 (each having its own individually known or determinable density) is used in the forward section 332—then the rearward section 334 is comprised in part of at least one secondary substance 370 having a known second density which is identifiably greater in value than any of the densities for the multiple primary materials 360.

This overall result is illustrated by FIGS. 6A and 6B which show the rearward section 334 as a preformed moiety comprising at least one secondary substance 370 and having a greater density than any primary material 360. Furthermore, as shown by FIGS. 6A and 6B, the prefabricated moiety is purposefully sized and configured to serve as the rearward section 334, which then is tangibly and permanently joined to the forward section 332 using conventionally known means to create and produce a kinetic energy enhanced drumstick 300. Consequently, in this exemplary model construct C, the secondary substance 370 (having a known second density which is identifiably greater in value than any of the densities for the multiple primary materials 360) constitutes and forms the entirety of the rearward portion 334 of the drumstick 300.

Moreover, as shown by FIGS. 6A and 6B, the location of the drumstick's mass center or fulcrum balance point 330 for the exemplary model construct C lies closer to the butt end 320 when compared to the mass center point of conventional drumsticks; thereby making the front tip 312, the neck 314, and the shoulder 316 feel far lighter than usual when the model construct 300 is held in the drummer's normal hand position. Thus, in both effect and function, the presence of the more dense secondary material 370 within the prefabricated rearward section 234 acts as a counter weight which makes the longer length front section 332 of the model construct 300 easier to be raised and lifted, and faster to use.

IV. Variables and Alternatives

The Range of Density Choices for the Secondary Substance

There is only one major requirement for any embodiment of the present invention, which is: The secondary requirement must be greater in density than any material used to form the tip, neck and the forward part of the shaft for the drumstick. This essential requirement allows the drummer and/or the manufacturer of the drumstick to choose from a precise and very desirable range of compositions and matter—a variety which includes not only many different kinds and densities of wood, but also offers the use of alternative metals, metallic alloys, and synthetic compositions. Merely illustrating some desirable examples of such compositions and matter are those presented by Tables 1 and 2 respectively below.

TABLE 1

| Wood - seasoned & dry | kg/cu.m |
|---|---|
| Afromosia | 705 |
| Apple | 660-830 |
| Ash, black | 540 |
| Ash, white | 670 |
| Aspen | 420 |
| Balsa | 170 |
| Bamboo | 300-400 |
| Birch (British) | 670 |
| Cedar, red | 380 |
| Cypress | 510 |
| Douglas Fir | 530 |
| Ebony | 960-1120 |
| Elm (English) | 600 |
| Elm (Wych) | 690 |
| Elm (Rock) | 815 |
| Iroko | 655 |
| Larch | 590 |
| Lignum Vitae | 1280-1370 |
| Mahogany (Honduras) | 545 |
| Mahogany (African) | 495-850 |
| Maple | 755 |
| Oak | 590-930 |
| Pine (Oregon) | 530 |
| Pine (Parana) | 560 |
| Pine (Canadian) | 350-560 |
| Pine (Red) | 370-660 |
| Redwood (American) | 450 |
| Redwood (European) | 510 |
| Spruce (Canadian) | 450 |
| Spruce (Sitka) | 450 |
| Sycamore | 590 |
| Teak | 630-720 |
| Willow | 420 |

TABLE 2

| Metal or alloy | kg/cu.m |
|---|---|
| aluminum - melted | 2560-2640 |
| aluminum bronze (3-10% Al) | 7700-8700 |
| aluminum foil | 2700-2750 |
| antifriction metal | 9130-10600 |
| beryllium | 1840 |
| beryllium copper | 8100-8250 |
| brass - casting | 8400-8700 |
| brass - rolled and drawn | 8430-8730 |
| bronze - lead | 7700-8700 |
| bronze - phosphorous | 8780-8920 |

TABLE 2-continued

| Metal or alloy | kg/cu.m |
|---|---|
| bronze (8-14% Sn) | 7400-8900 |
| cast iron | 6800-7800 |
| cobalt | 8746 |
| copper | 8930 |
| delta metal | 8600 |
| electrum | 8400-8900 |
| gold | 19320 |
| iron | 7850 |
| lead | 11340 |
| light alloy based on Al | 2560-2800 |
| light alloy based on Mg | 1760-1870 |
| magnesium | 1738 |
| mercury | 13593 |
| molybdenum | 10188 |
| monel | 8360-8840 |
| nickel | 8800 |
| nickel silver | 8400-8900 |
| platinum | 21400 |
| plutonium | 19800 |
| silver | 10490 |
| steel - rolled | 7850 |
| steel - stainless | 7480-8000 |
| tin | 7280 |
| titanium | 4500 |
| tungsten | 19600 |
| uranium | 18900 |
| vanadium | 5494 |
| white metal | 7100 |
| zinc | 7135 |

The Juncture Between the Less Dense Primary Material and the More Dense Secondary Substance There is only one meaningful requirement concerning the mode of construction and the manner in which the less dense primary material and the more dense secondary substance are joined together to form an unitary energy enhanced drumstick. That requirement is: The more dense secondary substance always must be positioned within the rearward section and be located at or beyond the drumstick's center of gravity and balance fulcrum—i.e., be positioned adjacent to or at the butt end of the construct. In the more preferred embodiments, the more dense secondary substance rests at and lies within the exterior surface boundaries of the butt end, as shown by FIG. 2B. However, embodiments conforming to the model construct alternatives illustrated by FIGS. 4, 5, and 6 respectively are all acceptable and equally desirable.

In most instances also, it is expected and intended that the overall configuration of the more dense secondary substance will have predetermined and fixed length, width, height and girth dimensions; will exist as a single unit or segment of more dense matter; and will be inserted and permanently joined to the less dense primary material forming the tip, neck and body of the drumstick. Thus as previously described herein in one alternative format, the more dense secondary substance can appear in multiple unit form—i.e., as a series of two or more balls, spheres, cubes, squares, rectangles; or as irregularly shaped units placed and used together in series to fill a cavity space core within the primary less dense material forming the tip, neck and body of the drumstick. In contrast as a second alternative mode, the secondary more dense material can form and exist as the entire solid butt end of the drumstick construction.

Clearly, many different manners of juncture are possible between the less dense primary and the more dense secondary materials. Among the immediately available choices are: all classic wood joinery and kinds of joints or fittings; any known adhesive, glue, or binding compositions; mechanical fasteners such as screws, nails, hooks, and clamps; and any conventionally known filling or flow technique which allows a heated metallic liquid or polymeric fluid to enter and fill a cavity space then existing within the shaft body or butt end of the drumstick.

Commercial Considerations

The invention has multiple benefits to drummers of all age ages, and of all styles of play. Playing the drums requires a certain amount of energy from the player, which can be more or less, depending on the skill level and technique of the individuals. All of these movements can also take a toll on the player's energy level, and on the player's physical damage over time. The invention, constructed with an additional mass feature, creates more kinetic energy, which in turn creates more a higher and faster stick rebound. This allows the player to back off on the amount of energy that he/she puts into creating the desired speed and volume of sound, and to be able to increase their playing speed. There is an added benefit over time for the player, of less wear and tear on the body and joints, by not having to work as hard for the desired effect.

The added mass also creates more tone, which is a desired benefit. There is also less vibration being transferred into the player's hands and joints, which further helps to reduce physical wear and tear over time.

The present invention is not to be restricted in form nor limited in form except by the claims appended hereto.

What I claim is:

1. A kinetic energy enhanced drumstick comprised of at least one primary material having a first density and at least one secondary substance having a second density which is greater than the first density of the primary material, wherein said drumstick has (i) a predetermined length and known girth dimensions, (ii) a fixed configuration which presents a shaped tip, an elongated shaft portion, and a butt end, (iii) a mass center location at which the drumstick length is separated into discrete forward and rearward sections, (iv) a forward section fashioned entirely of said primary material having said first density, and (v) a rearward section fashioned entirely of said secondary substance having said second density.

2. A kinetic energy enhanced drumstick comprised of at least one primary material having a first density and at least one secondary substance having a second density which is greater than the first density of the primary material, wherein said drumstick has (i) a predetermined length and known girth dimensions, (ii) a fixed configuration which presents a shaped tip, an elongated shaft portion, and a butt end, (iii) a mass center location at which the drumstick length is separated into discrete forward and rearward sections, (iv) a forward section fashioned of at least said primary material having said first density, and (v) a rearward section fashioned of a combination of at least said primary material having said first density and said secondary substance having said second density.

3. A kinetic energy enhanced drumstick comprised of at least one primary material having a first density and at least one secondary substance having a second density which is greater than the first density of the primary material, wherein said drumstick has (i) a predetermined length and known girth dimensions, (ii) a fixed configuration which presents a shaped tip, an elongated shaft portion, and a butt end, (iii) a mass center location at which the drumstick length can be is separated into discrete forward and rearward sections, (iv) a forward section fashioned of said primary material having said first density, (v) a rearward section whose exterior surface is formed at least in part of said primary material having said first density, (vi) at least one interior cavity of preset shape, dimensions, and volume housed within said rearward section, and (vii) a predetermined amount of said secondary substance having said second density disposed within said interior cavity of said rearward section.

4. The kinetic energy enhanced drumstick as recited in claim 3 wherein there are multiple interior cavities housed within said rearward section.

5. The kinetic energy enhanced drumstick as recited in claim 4 wherein there are a plurality of different secondary substances contained within said multiple interior cavities of said rearward section.

6. The kinetic energy enhanced drumstick as recited in claim 1, 2, or 3 wherein a plurality of different secondary substances, each having a density greater than the first density of said primary material, are disposed within said rearward section.

7. The kinetic energy enhanced drumstick as recited in claim 2 or 3 wherein said forward section of said drumstick is fashioned entirely of one primary material having said first density.

8. The kinetic energy enhanced drumstick as recited in claim 1, 2, or 3 wherein a plurality of different primary materials are used in combination within said forward section.

9. The kinetic energy enhanced drumstick as recited in claim 2 or 3 wherein said rearward section of said drumstick is fashioned entirely of one secondary substance having said second density.

10. The kinetic energy enhanced drumstick as recited in claim 1, 2, or 3 wherein said primary material is a wood.

11. The kinetic energy enhanced drumstick as recited in claim 1, 2, or 3 wherein said secondary substance is a wood.

12. The kinetic energy enhanced drumstick as recited in claim 1, 2, or 3 wherein said secondary substance is selected from the group consisting of metals, metallic alloys, and metal-containing mixtures having a known density.

* * * * *